US006530320B2

(12) United States Patent
Dagnet et al.

(10) Patent No.: US 6,530,320 B2
(45) **Date of Patent: *Mar. 11, 2003**

(54) SEGMENTED INKING BLADE CONFIGURATION AT AN INK FEEDING DEVICE

(75) Inventors: Jean Pierre Dagnet, Gouvieux (FR); Xavier Delassus, Nogent sur Oise (FR); Pascal Grincourt, Berthecourt (FR); Michel Ricard, St. Vaast les Mello (FR)

(73) Assignee: Heidelberger Druckmaschinen AG, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/521,860

(22) Filed: Mar. 8, 2000

(65) Prior Publication Data

US 2002/0170449 A1 Nov. 21, 2002

(30) Foreign Application Priority Data

Mar. 11, 1999 (DE) ..... 199 10 989
Dec. 20, 1999 (FR) ..... 99 16059

(51) Int. Cl.[7] ..... B41F 31/04
(52) U.S. Cl. ..... 101/365; 101/350.1; 101/350.6
(58) Field of Search ..... 101/365, 350.6, 101/350.1, 364, 367

(56) References Cited

U.S. PATENT DOCUMENTS

| | | | | | |
|---|---|---|---|---|---|
| 2,666,386 | A | | 1/1954 | Jovishoff et al. | 101/364 |
| 4,328,748 | A | | 5/1982 | Schramm | 101/365 |
| 4,329,923 | A | * | 5/1982 | Iida | 101/365 |
| 4,350,095 | A | * | 9/1982 | Simeth | 101/365 |
| 4,495,864 | A | * | 1/1985 | Junghans | 101/365 |
| 5,694,851 | A | * | 12/1997 | Bruni | 101/365 |
| 5,857,412 | A | * | 1/1999 | Roskosch et al. | 101/365 |

FOREIGN PATENT DOCUMENTS

| | | | |
|---|---|---|---|
| DE | 3323049 | 3/1984 | B41F/31/12 |
| EP | 0453872 | 1/1996 | B41F/31/04 |
| EP | 0753408 | 1/1997 | B41F/31/04 |
| GB | 16360 | 9/1892 | B41F/31/04 |

* cited by examiner

*Primary Examiner*—Ren Yan
*Assistant Examiner*—K. D. Williams
(74) *Attorney, Agent, or Firm*—Davidson, Davidson & Kappel, LLC

(57) ABSTRACT

The present invention relates to an inking blade configuration for an ink feeding device of a rotary press, which includes a carrier beam provided at the ink duct. The inking blade is composed of segments, which are accommodated in a side-by-side configuration on the carrier element and which are adjustable relatively to a roller that dips into the ink duct, and the individual inking blade segments are connected by connecting elements to the carrier element. Provision is made underneath the connecting elements (8) in the contact region (9) of the contact surfaces (11, 12) of segments (2) and of the carrier beam (5) for a form-locking connection (13), which prevents a relative movement between the segments (2) and the carrier beam (5).

13 Claims, 3 Drawing Sheets

SEGMENTED INKING BLADE CONFIGURATION AT AN INK FEEDING DEVICE

BACKGROUND OF THE INVENTION

1. Field of the Invention

The present invention relates generally to printing presses and more particularly to inking blades for printing presses.

2. Background Information

European Patent Application No. 0 753 408 A1 describes a method for installing a metering device in a rotary press. In this method for mounting inking blades of a rotary press that cooperate with an ink duct roller, the objective is to produce a small, uniform clearance between each of the segments of the inking blade. EP 0 753 408 A1 achieves this objective by heating and subsequently cooling the inking blade segments, which are mounted side-by-side without any clearance.

In accordance with an inking blade configuration from European Patent Application No. 0 453 872 B1, inking blades are configured on carrier elements at an ink duct of a rotary press, the inking blade being secured by screws at the ink duct, and being adjustable in its longitudinal direction. A setting mechanism is used to deflect the inking blade out resiliently, transversely to its longitudinal surface, in each case making it adjustable, with clearance, with respect to a roller that dips into the ink duct. The inking blade is composed of flexible tongues, which are disposed in a side-by-side configuration and are adjustably secured to the carrier element in the longitudinal direction of the tongues, to compensate for wear. In a region provided for securing the tongue to the carrier element, each tongue is provided with a centrically placed slotted hole, which enables the tongue to be adjusted in the longitudinal direction at the carrier element. The length of each slotted hole is dimensionally designed to be shorter then the clearance between the edge of the carrier element facing the roller and the screw, provided for securing the carrier element, facing away from the roller.

It has been established that related-art inking blade configurations, whose individual inking blade segments are retained by a connecting element, such as a screw or the like, on a carrier beam (i.e., a supporting crosspiece), tend to experience relative movements with respect to the carrier beam. Although the related-art screw connections do clamp the contact surface of inking blade segments underneath the carrier beam, the inking blade segments are able to shift relatively to their clamped position at the carrier beam. This is highly undesirable, since any deterioration in the preset inking blade position alters the ink quantity determined by this position, the ink quantity being supplied via the particular inking blade segment of the ink zone in question. In addition, there is the risk of potential damage to the ink duct roller, as well as of abrasion gradually setting in at the front edge of the segment.

SUMMARY OF THE INVENTION

Starting out from the background information delineated above, in the case of an ink metering device having inking blade segments arranged by zones, the present invention is directed to improving the contact between inking blade segments and the carrier beams that support them, so as to rule out relative movements once a presetting operation is implemented.

The present invention thus provides an inking blade configuration for an ink feeding device of a rotary press, comprising a carrier beam provided at the ink duct, the inking blade being composed of segments, which are accommodated in a side-by-side configuration on the carrier element and which are adjustable relatively to a roller that dips into the ink duct, the individual inking blade segments being connected by connecting elements to the carrier element, characterized in that a form-locking connection (13) is provided underneath the connecting elements (8) in the contact region (9) of the contact surfaces (11, 12) of the segments (2) and of the carrier beam (5).

The advantages associated with the present invention lie, inter alia, in that a relative movement of an inking blade segment with respect to the carrier beam of the inking blade is ruled out, in particular a rotation out of the right angle, in which the segments are secured in relation to the carrier beam. The design approach in accordance with the present invention reduces the premature wear experienced by the front edge of the segments, which, per inking zone, are able to be brought into contact with the ink duct roller, thereby prolonging the service life and durability of the inking blade segments.

In an advantageous embodiment of the idea underlying the present invention, the contact surfaces of the inking blade segment and of the carrier beam can be provided with a roughened surface, to enhance the friction that inhibits a relative movement between the contact surfaces. One aspires in this case to a roughest possible surface. Alternatively, a form-locking type connection is able to be achieved between the contact surfaces of the segments and those of the carrier beam in that linear elevations are formed on the bottom side of the segments and on the top side of the carrier beam. If the inking blade segments and the carrier beam are screw-coupled to one another or joined together in some other manner, the linear elevations intermesh and prevent a relative movement of the segment with respect to the carrier beam. The regions of the segments and of the carrier beam where these linear elevations are formed, can be hardened using setting methods, to prevent them from undergoing any positional change during assembly.

The aforesaid linear elevations extend advantageously in parallel to the carrier beam reaching under the individual segments. Even given a longitudinal extension of the linear elevations in the longitudinal direction of the inking blade segment, a relative movement of the segments with respect to the carrier beam is able to be prevented, ensuring that the right-angled alignment of the inking blade segments with respect to the carrier beam is not adversely affected, and that it is retained.

The form-locking connection between the segments of the inking blade and the carrier beam can also be constituted of a toothed formation that is manufactured with utmost precision. In this form-fit configuration of segment and carrier beam, the individual teeth flanks contact one another contiguously and counteract a relative movement between the inking blade segment and carrier beam. A hardening process can also be used to treat the flank surfaces of the teeth.

The inking blade configuration in accordance with the present invention can be advantageously employed in an ink duct of rotary presses, as used, for example, in printing units of rotary presses in the commercial or newspaper printing sector.

BRIEF DESCRIPTION OF THE DRAWINGS

The present invention is elucidated in the following on the basis of the following figures, in which.

DETAILED DESCRIPTION

Figure 1:
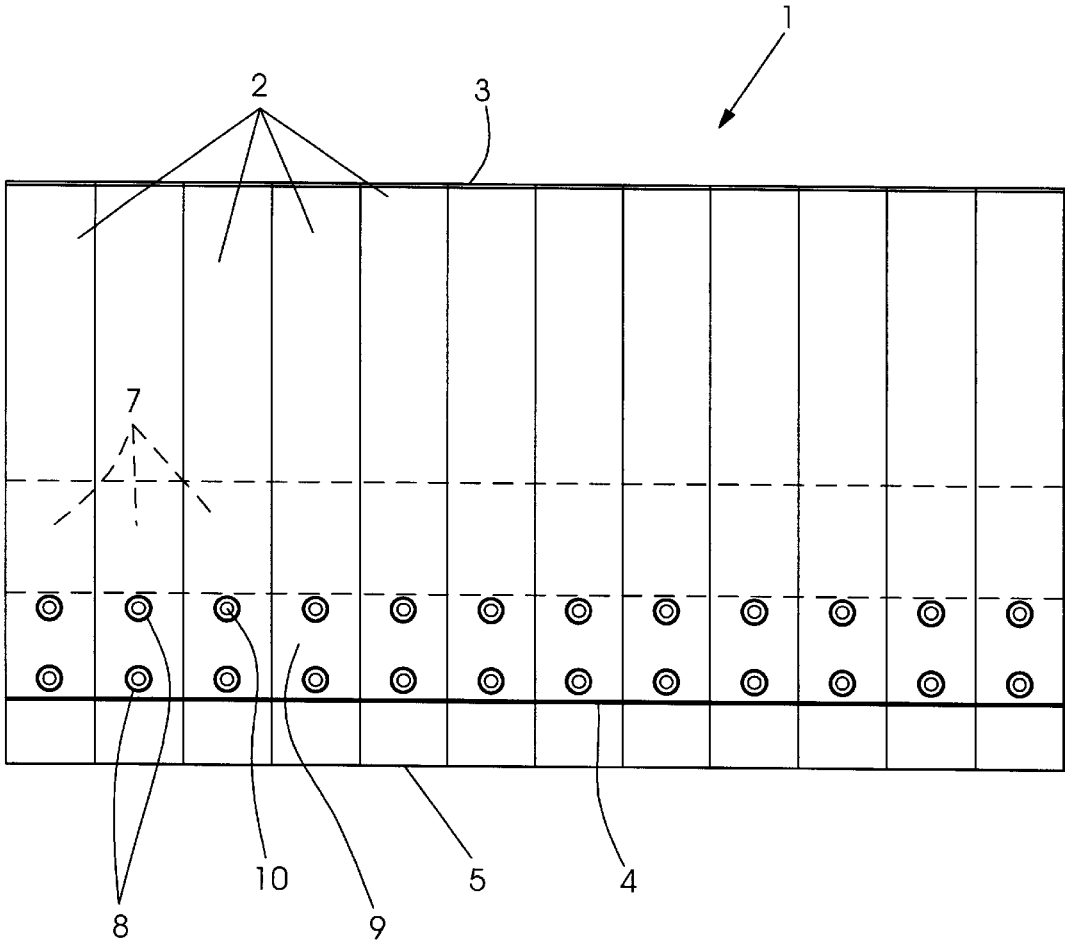
FIG. 1 shows the plan view of an inking blade extending over one area of an ink duct.

The representation in accordance with FIG. 1 shows an inking blade configuration, where individual segments 2 rest in a side-by-side arrangement on a carrier beam 5. Front edge 3 of segments 2 is brought into contact with the surface of an ink duct (fountain) roller, which, however, is not shown in FIG. 1. Front edges 3 of segments 2 are able to be brought, however, into more or less intense contact with the surface of the ink duct roller, by zones, and in an individually predefinable manner in accordance with the ink film thickness to be adjusted, so that, per inking zone, a specific ink film thickness and, thus, a specific ink quantity reaches the inking unit and, from there, the printing form or plate.

The rear sections of segments 2 are fixed by connecting elements 8 to a carrier beam 5. Reference numeral 9 denotes the contact region between the bottom side of segments 2 and the top side of carrier beam 5. Connecting elements 8 extend through bore holes 10, which can also be conceived, in accordance with FIG. 2, as slotted holes, and permit inking blade segments 2 to be clamped at the top side of carrier beam 5. Disposed underneath segments 2 are weakened regions 7 of segments 2, which have the distinctive feature of reduced material strength. In the vicinity of front edges of segments 2, setting mechanisms engage with segments 2, to vary the setting (i.e. the screw down position) of front edge 3 of respective inking blade segment 2 at the surface of the ink duct roller as a function of the desired ink film profile. However, the setting mechanisms are not the object of the present invention. The setting mechanisms, which permit segments 2 to be adjusted independently, by zones, impress a relative movement upon segments 2, acting primarily on their front edge 3, but also affecting contact region 9, where the rear sections of segments 2 are connected to carrier beam 5.

Figure 2A:
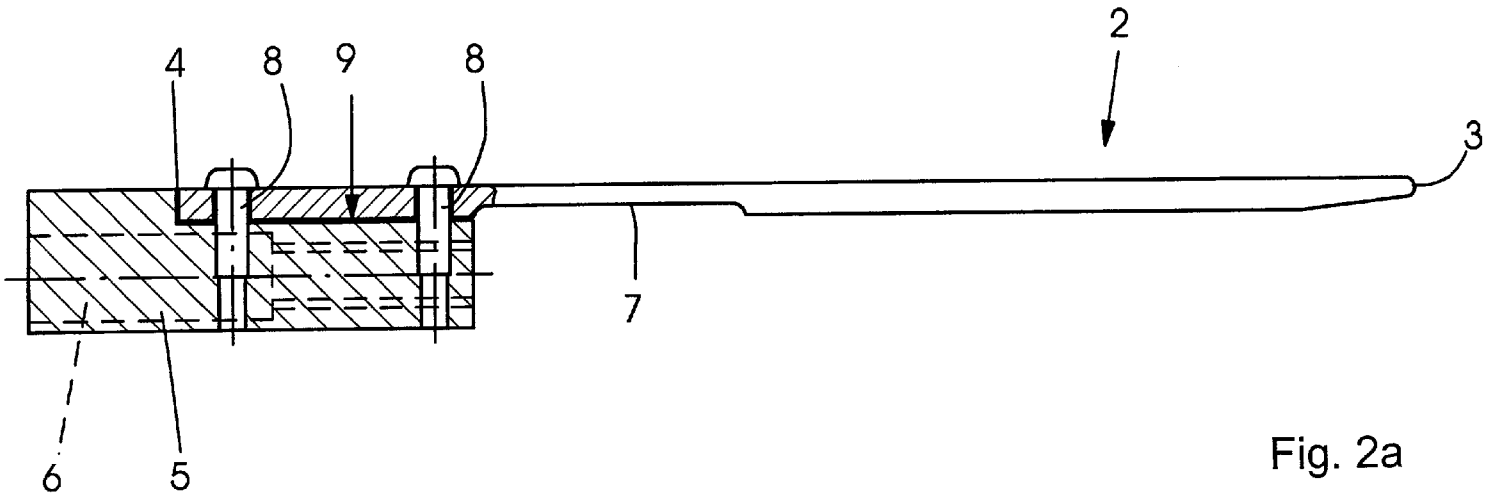
FIG. 2*a* shows the side view of an inking blade segment, including an enlarged detail of the contact region.
Figure 2B:
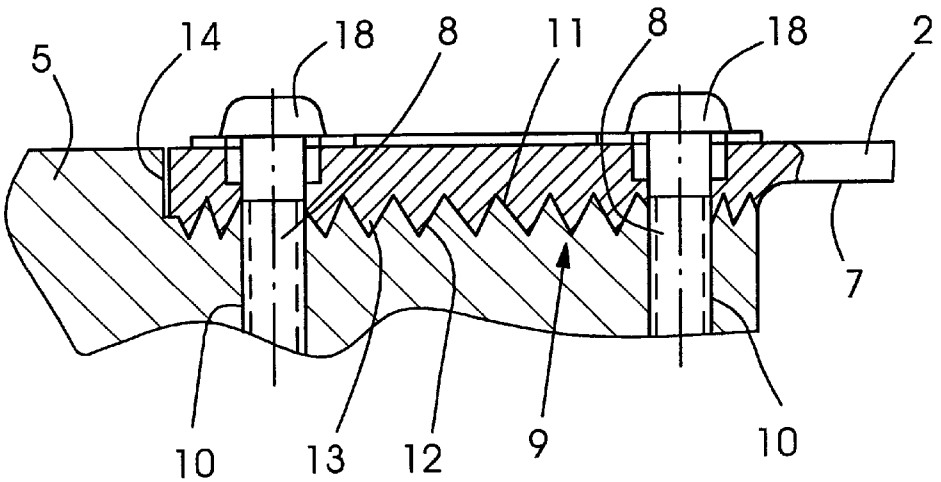
FIG. 2*b* shows a side view of an alternative embodiment to the FIG. 2*a* embodiment.

FIGS. 2*a* and 2*b* depict an inking blade segment in a side view, with an enlarged representation of contact region 9.

Segment 2, which is screw-coupled to carrier beam 5 and has a rear edge 4, is connected by connecting elements 8, which can be bolts or screws, to carrier beam 5. Carrier beam 5 can have a plurality of bore holes 6—depicted here as covered, and thus invisible—which enable it to be accommodated in an ink duct. Bore holes 10, which traverse connecting elements 8, extend through the rear sections of segments 2 into carrier beam 5. Connecting elements 8 are used for screw-coupling segments 2 to carrier beam 5. Since the bore holes are designed with tolerances, a relative movement between the rear segment sections and carrier beam 5 can arise even when the screws used as connecting elements 8 are tightened to the highest permissible tightening torque. This effect can also occur in the case of bore holes designed as slotted or elongated holes.

The form-locking type connection 13 in accordance with the present invention in contact region 9 between bottom side 11 of segments 2 and top side 12 of carrier beam 5 prevents a relative movement between the two frictional partners.

The form-locking type connection 13 is shown in an enlarged view in accordance with the details in FIG. 2*b*. To clearly show a toothed formation, the slope angles and depth of the teeth are shown in an enlarged view. In practical use, the height of the teeth of toothed formation 13, as well as the slope angle of the teeth flanks are substantially smaller than shown in FIG. 2*b*. Connecting elements 8 are used to screw-couple segments 2 to carrier beam 5; a deflection about the vertical axis of the segments, or a rotation of the rear segment sections at carrier beam 5 is effectively prevented by form-locking connection 13. The form-locking connection shown in detail in accordance with FIG. 2*b* is designed as a toothed formation 13, whose teeth surfaces run transversely to the longitudinal extension of segments 2; toothed formation 13 could run just as well in the longitudinal direction, in parallel to the longitudinal extension of segment 2, or at any desired angle, to rule out a relative movement of the rear sections of segment 2 with respect to carrier beam 5.

The segment bottom side and carrier beam top side, designed, for example, as toothed contact surfaces 11 and 12, respectively, are set into carrier beam 5 in such a way that the surface of segment 2 forms a common surface with carrier beam 5, reference numeral 14 denoting a stop face, which predetermines a preliminary positioning of segment 2 at carrier beam 5. In the representation in accordance with FIGS. 2*a* and 2*b*, the connecting elements are designed as screws having rounded heads. One can, of course, also conceive of other specific embodiments of connecting elements 8 for securing segments 2 to carrier beam 5.

Instead of designing toothed formation 13 shown in FIG. 2*b* as a form-locking connection, contact surfaces 11 and 12 of segment 2 and carrier beam 5, respectively, can also be formed with enhanced surface roughness. To improve friction, a high roughness value is aspired to, thus a rough surface of both frictional partners 2, 5 in contact region 9, as shown for example in FIG. 2*a*. A form-locking connection 13 in contact region 9 can not only be achieved by a toothed formation or increased roughness for both frictional partners, but also by the intermeshing of linear elevations. This can be provided at contact surface 11 of segments 2 and at contact surface 12 of carrier beam 5, or only at one of the two surfaces named. The linear elevations can extend both in parallel to the longitudinal extension of carrier beam 5, as well as transversely thereto. When segments 2 are mounted on carrier beam 5, the linear elevations intermesh and effect a form-locking connection between the rear segment section and carrier beam 5. The linear elevations are also able to be hardened using a setting process, to enhance fatigue strength and prevent displacement during assembly. The profile of the elevations must not necessarily be linear, it could also be punctiform, or of some other geometry.

Figure 3:
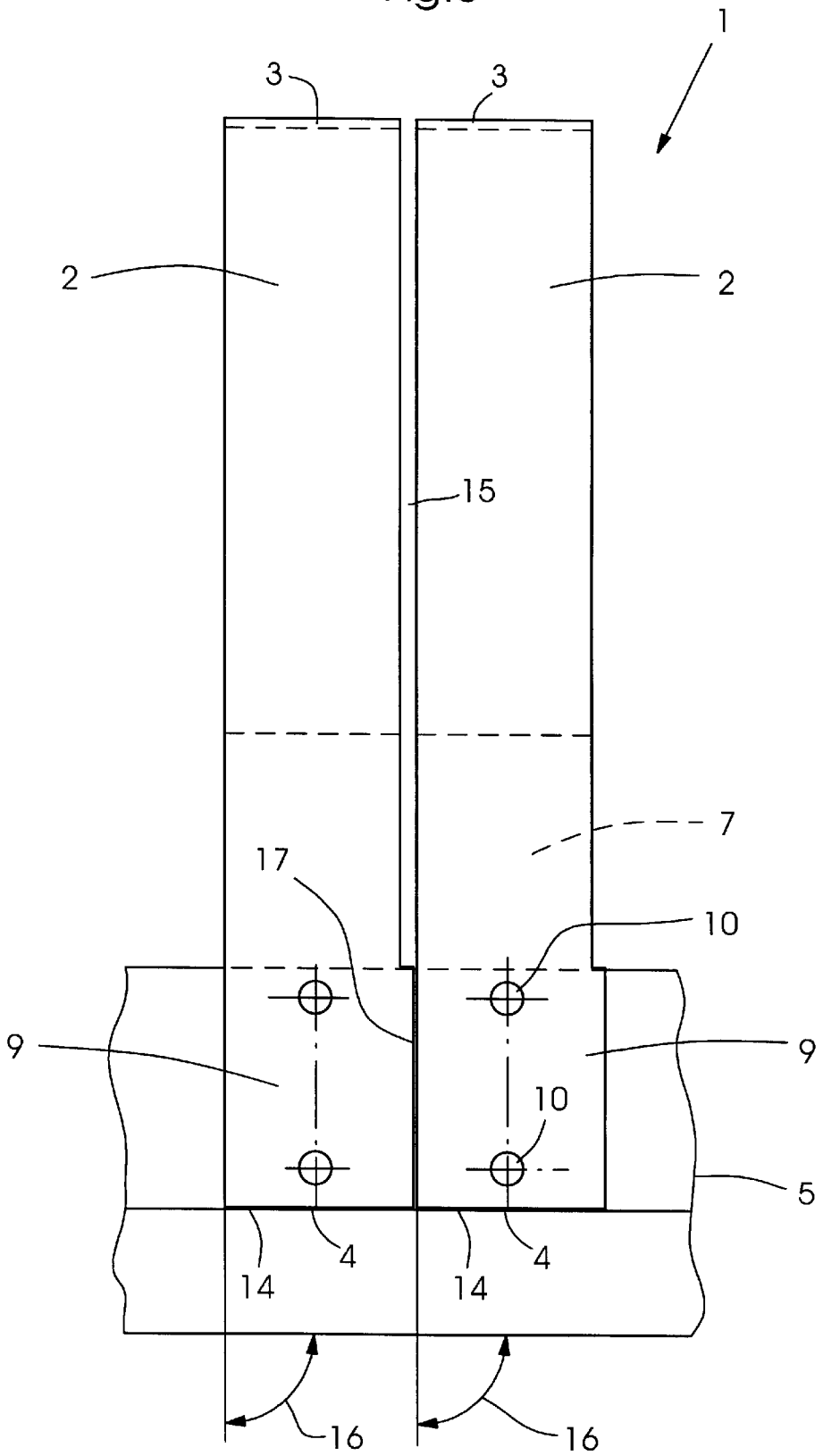
FIG. 3 shows a plan view, on an enlarged scale, of inking blade segments accommodated on the carrier beam of an inking blade configuration.

FIG. 3 shows an enlarged representation of two segments of an inking blade.

The alignment of a segment 2 in relation to carrier beam 5 can be checked on the basis of position angle 16. Individual segments 2 widen at their rear sections, thereby forming clearance 15 between segments 2. Segments 2 fit on one another at parallel limit stops 17; clearance 15 between segments 2 could be sealed by rubber strips, or by other flexible, moldable compounds, to prevent an undesirable leakage of ink out of the ink duct. Clearance 15 between individual segments 2 enables individual segments 2 to be adjusted in relation to adjacent segments 2 in a manner that is free of secondary effects. Form-locking connection 13 provided in contact region 9 underneath segment 2 and carrier beam 5 prevents any variation in position angle 16, during operation, out of its right-angled preset position. Form-locking connection 13 ensures a continually correct alignment of front edge 3 of segment 2, while retaining position angle 16 of segment 12 in relation to carrier beam 5. In this manner, front edge 3 of segment 2 of the inking blade configuration always remains correctly aligned with respect to the surface of the ink duct roller, regardless of the particular ink film thickness adjusted at the moment in the zone in question by the setting mechanism—not shown here—acting upon the front edge of segments 2.

The terms ink duct and ink fountain as used herein are interchangeable.

REFERENCE SYMBOL LIST

1 inking blade configuration
2 individual segments
3 segment front edge
4 segment rear edge
5 carrier beam
6 bore hole
7 weakened zone
8 connecting element
9 contact region carrier beam/segment
10 bore hole
11 contact surface of segment
12 contact surface of carrier beam
13 toothed formation, form-locking connection
14 stop face
15 clearance
16 position angle
17 parallel limit stop
18 rounded head

What is claimed is:

1. An inking blade for an ink feeding device of a rotary press, the inking blade comprising:

a carrier element provided at an ink duct, said carrier element having a first contact surface; and a plurality of individual, separate blade segments accommodated in a side-by-side configuration on the carrier element, each individual, separate blade segment of the plurality of individual, separate blade segments having a second contact surface and being connected to the carrier element by respective connecting elements so as to define a contact region between said first and second contact surfaces of the carrier element and each of the blade segments, respectively, the plurality of individual, separate blade segments being adjustable relatively to an ink roller, the ink roller contacting the ink duct, said first contact surface of the carrier element having a first plurality of teeth facing said second contact surface of each of said blade segments, said second contact surface of each of said blade segments having a second plurality of teeth meshing with said first plurality of teeth and forming a form-locking connection therewith.

2. The inking blade as recited in claim 1 wherein the first and second contact surfaces are intermeshing, linear elevations.

3. The inking blade as recited in claim 2 wherein the linear elevations extend in parallel to the carrier element reaches under the segments.

4. The inking blade as recited in claim 1 wherein the form-locking connection is a toothed formation.

5. The inking blade as recited in claim 4 wherein the toothed formation includes a plurality of teeth.

6. The inking blade as recited in claim 1 wherein the segments are set into the carrier element in the contact region, and a longitudinal displacement of the segments is limited by a stop face.

7. The inking blade as recited in claim 1 wherein the carrier element is a carrier beam.

8. The inking blade as recited in claim 1 wherein the connecting elements are at least one of bolts and screws.

9. The inking blade as recited in claim 1 wherein the carrier beam is presettable.

10. An ink feeding device of a rotary press comprising:

a carrier element provided at an ink duct, said carrier element having a first contact surface, a plurality of individual, separate blade segments accommodated in a side-by-side configuration on the carrier element, each individual, separate blade segment of the plurality of individual, separate blade segments having a second contact surface and being connected to the carrier element by respective connecting elements so as to define a contact region between said first and second contact surfaces of the carrier element and each of the blade segments, respectively, the plurality of individual, separate blade segments being adjustable relatively to an ink roller, the ink roller contacting the ink duct, said first contact surface of the carrier element having a first plurality of teeth facing said second contact surface of each of said blade segments, said second contact surface of each of said blade segments having a second plurality of teeth meshing with said first plurality of teeth and forming a form-locking connection therewith.

11. An ink feeding device of a rotary press comprising:

a carrier element, the carrier element having a first contact surface, said first contact surface having a first plurality of teeth; and a plurality of individual, separate blade segments each connected by respective connecting elements to the carrier element in a side-by-side configuration, the plurality of blade segments each having a second contact surface having a second plurality of teeth meshing with the first plurality of teeth so as to fix a position of the second contact surface with respect to the first contact surface.

12. The ink feeding device as recited in claim 11 wherein the first and second contact surfaces are form-locking.

13. A method of providing ink from an ink fountain to a ink roller comprising the steps of:

providing a carrier element having a first contact surface, said first contact surface having a first plurality of teeth;

attaching a plurality of individual, separate blade segments through respective connecting elements to the carrier element in a side-by-side configuration so that a second plurality of teeth formed on a second contact surface of each of the plurality of blade segments meshes with the first plurality of teeth, and metering ink to the ink roller through the plurality of blade segments.

* * * * *